US009118095B2

(12) United States Patent
Smith

(10) Patent No.: US 9,118,095 B2
(45) Date of Patent: Aug. 25, 2015

(54) CAPACITIVE RF COUPLER FOR UTILITY SMART METER RADIO FREQUENCY COMMUNICATIONS

(75) Inventor: Norman J. Smith, Santa Rosa, CA (US)

(73) Assignee: RF SAVVY TECHNOLOGIES, LLC, Santa Rosa, CA (US)

( * ) Notice: Subject to any disclaimer, the term of this patent is extended or adjusted under 35 U.S.C. 154(b) by 491 days.

(21) Appl. No.: 13/603,219

(22) Filed: Sep. 4, 2012

(65) Prior Publication Data

US 2013/0057367 A1 Mar. 7, 2013

Related U.S. Application Data

(60) Provisional application No. 61/530,547, filed on Sep. 2, 2011.

(51) Int. Cl.
*H01P 5/02* (2006.01)

(52) U.S. Cl.
CPC ..... *H01P 5/02* (2013.01)

(58) Field of Classification Search
None
See application file for complete search history.

(56) References Cited

U.S. PATENT DOCUMENTS

| | | | | |
|---|---|---|---|---|
| 5,621,419 | A * | 4/1997 | Meek et al. | 343/770 |
| 6,300,881 | B1 | 10/2001 | Yee et al. | |
| 8,305,233 | B2 | 11/2012 | Ellsworth, III | |
| 2010/0253538 | A1 | 10/2010 | Smith | |

* cited by examiner

*Primary Examiner* — Stephen E Jones
(74) *Attorney, Agent, or Firm* — Craig M. Stainbrook; Stainbrook & Stainbrook, LLP

(57) ABSTRACT

Method and apparatus for locating a low insertion loss apparatus for capacitive coupling of radio frequency (RF) signals from within the confines of a dielectric housing of a utility meter, through the dielectric cover, avoiding the need for drilling a hole in the utility meter body or meter dielectric cover, to route the coaxial RF cable from the embedded wireless modem to an external remote antenna or in-line power amplifier. Specifically the invention relates to an improved capacitive coupling method, which provides for an un-tethered or tethered integral radio frequency (RF) coupler where said RF coupler is located within and on the outer surface of a replacement dielectric cover or alternately retro-fitted on the inner surface and outer surface of an existing utility meter dielectric cover. A method and apparatus for a, standalone, alternative embodiment of the capacitive RF Coupler apparatus is also described and illustrated herein.

20 Claims, 5 Drawing Sheets

CAPACITIVE RF COUPLER FOR UTILITY SMART METER RADIO FREQUENCY COMMUNICATIONS

CROSS REFERENCES TO RELATED APPLICATIONS

The present application claims priority to U.S. Provisional Patent Application Ser. No. 61/530,547, filed Sep. 2, 2011.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to capacitive radio frequency (RF) couplers for utility meters, and more particularly to a capacitive radio frequency parallel plate capacitor coupler structure that exhibits very low RF insertion loss (high coupling) while ensuring high electrical isolation, that meets or exceeds current industry safety standards, between a wireless Network Interface Card (NIC) RF connection and the external antenna of an electricity utility meter enclosed within vandal proof enclosures, typically manufactured from metal or other materials, which cannot be penetrated by radio frequency signals.

2. Background Discussion

In response to climate change nations around the world have recognized the urgent need to reduce carbon emissions and energy consumption. Governments in the United States, Canada, China, and Europe have begun adopting the SMART Grid technology as a means of stimulating depressed economies with green-tech jobs and by passing significant stimulus packages to subsidize utilities that are installing wireless-enabled automated (or advanced) metering infrastructure (AMI) and Smart Utility Meters. [As used herein, "SMART meters" refer to any kind of utility meter that records consumption and transmits recorded data back to a utility company on a predetermined basis.]

Even though Smart meter deployment rates have risen into the tens of millions of units per year, it is nonetheless estimated that 5%-10% of Smart utility meters, with internal antennas, cannot be read remotely due to insufficient local wireless coverage, underground installations, or signal loss caused by installation in vandal proof metal enclosures. Ironically in such cases utilities are forced either to continue reading the Smart meter manually, which undermines the return on investment and carbon emission objectives, or they can install an external remotely located antenna to increase the radio signal strength at the meter site and enable remote network connectivity.

Typically the decision to use a remote external antenna is made by an installer, and in making such a decision, careful consideration must be given to electrical safety of the installation. In low-cost residential meter installations, the power supply to the radio modem (sometimes called a Network Interface Card ("NIC")) is frequently not isolated from a high AC supply voltage. For an external antenna, this installation scenario dictates the use of a device that can safely isolate the NIC radio frequency (RF) connection to the remote external antenna while enabling a low-loss RF connection with a high degree of RF coupling for the external antenna. The traditional means used for such RF coupling, including, for instance, an external flex antenna placed on the outside of the meter cover to loosely couple to the internal antenna, are 'make-shift' in nature, highly inefficient, and result in typical coupling losses of −5 dB to −6 dB. Other proprietary forms of power isolation that have been developed use lumped element components (such as inductors and capacitors) that result in narrow band solutions with inherent reliability issues.

Thus, there remains a need for electric utilities to have a safe and efficient (low loss) means for routing an RF cable from an NIC inside the utility meter to an external remote antenna, so as to boost the wireless signal at certain installation sites.

BRIEF SUMMARY OF THE INVENTION

The present invention recognizes short comings in, and seeks to improve upon, prior art glass mounted antenna RF couplers typically deployed in the automotive industry by providing a novel ultra wide-band RF coupler, that exhibits a high degree of electrical safety isolation in both the signal path and ground path connections, located integral to the cover of the utility meter or alternately a stand-alone RF component coupler located within the confines of the utility meter dielectric housing.

The RF coupler of the present invention is specifically adapted for application in the field of Smart wireless-enabled utility meter customer premise equipment (CPE), RF Collectors, Wireless Repeaters, RF concentrators and other related Smart Grid RF enabled transmission equipment such as SCADA applications. In an embodiment of the present invention, as a stand-alone RF capacitive coupler, the inventive apparatus solves an unmet need in the utility meter industry by providing a radio frequency (RF) connection between the wireless modem, located within the confines of the utility meter dielectric housing and a remote external antenna while simultaneously electrically isolating the RF ground and RF signal paths to the remote external antenna, thereby providing a circuit that is electrically safer than a direct RF connection.

The present invention is adapted for use in Smart utility meters configured for wireless remote automated meter reading or location-based services using an internal wireless modem located within the confines of the dielectric housing, the utility meter being located within the confines of a metal vandal proof enclosure. Alternately the present invention can be used in utility meters not enclosed in a vandal proof enclosure, but instead located in an area where a radio signal from a wireless terrestrial public cellular or private spectrum network or neighboring mesh network nodes or a telecommunications satellite or GPS satellite is weak enough that it dictates the use of a remote mounted antenna external to the utility meter dielectric cover itself.

This invention solves an unmet need in the industry for utility meter installation electrical safety requirements, specifically where it is necessary for utility companies to connect an external remotely located antenna to the RF port of the wireless modem located inside the dielectric cover of the utility meter and where the wireless modem is not powered by an isolated electrical power supply.

The inventive apparatus may also be used for applications where the utility meter may not be in a metal enclosure but nevertheless is unable to generate a signal with strength sufficient to reach a distant wireless network and is therefore required to use an external or remote antenna to boost the performance.

In all of the foregoing examples the utility meter will have been configured with a wireless modem within the confines of its dielectric housing for remote automated meter reading using radio frequency communication technologies.

The process and methods taught in the instant application are directly applicable to a plurality of radio communication operating frequencies and standards associated with utility meter wireless automated meter reader communication and location based radio communication systems including but not limited to; industrial, scientific, and medical ("ISM") band mesh networks, wide-area-networks, wireless local-area-networks, private licensed spectrum, GPS satellites, telecommunication satellites, or public cellular communication networks.

In the preferred embodiment of the invention an improved method of mounting an embedded and innovative two-dimensional capacitive RF coupler is provided. The RF coupler design is such that it enables a tethered or un-tethered integral capacitive coupling element to be located within, and a matching coupler element to be located outside of, a replacement dielectric cover of a utility meter.

In the preferred embodiment the two dimensional internal coupler structure is created by permanently forming the coupler element into the dielectric cover using an insert-mold, over-mold, or molded interconnect manufacturing process to create a single piece component that directly replaces the original dielectric cover with one containing integral coupler elements.

In the preferred embodiment of the invention, the replacement dielectric cover material remains the same as the original manufacturer specifications.

In some cases, and therefore in another embodiment, due to the inadequacy of the radio frequency properties of the original dielectric cover (for example if the dielectric material absorbs too much radio frequency energy from the coupler), it may be necessary to maintain satisfactory coupler efficiency for the replacement dielectric cover to be manufactured from a dielectric material having an effective dielectric constant in the range of 4.5 or less in addition to containing zero or very low percentage content of radio frequency reflective or absorbing material compositions.

In other cases, and therefore in yet another embodiment, due to the inadequacy of the thickness of the original dielectric cover, it may be necessary to reduce insertion loss of the coupler for the replacement dielectric cover to be manufactured from a dielectric material with a thinner wall than the original cover in the vicinity of the coupler elements, and thereby reducing the capacitance and improving the insertion loss of the apparatus.

In yet another embodiment of the invention and upon examination of the following drawings, detailed descriptions and prior art references, it will be appreciated that the invention can be adapted and applied by retro-fitting the inside and external face of an existing utility meter dielectric cover with a matching pair of conformal RF coupler structures such as a quarter wave patch, capacitive patch and ring, slot or aperture or other coupler topologies to achieve the same benefits and improvements over the prior art.

In still another embodiment of the invention and upon examination of the following drawings, detailed descriptions and prior art references, it will be appreciated that the invention can be adapted and applied by retro-fitting the inside and external face of an existing utility meter dielectric cover with a matching pair of conformal antenna structures, such as a pair of monopoles or dipoles or other antenna topologies, to achieve the same benefits and improvements over the prior art.

In still another alternative embodiment, and upon examination of the following illustrations and descriptions, it will be appreciated that the apparatus can be readily adapted to form a standalone radio frequency (RF) coupler comprising a thin dielectric substrate with a matching pair of conductive coupler element circuits located on either side of the dielectric substrate, said coupler elements being similar in design and dimensions to the preferred embodiment. In this alternative embodiment of the invention the connections to the RF coupler apparatus would be made via a pair of RF connectors or alternately can be made via a pair of RF coaxial cables (see, for instance, FIG. 9) to achieve a low loss RF coupling while simultaneously providing electrical isolation between input and output connections to the apparatus in both the RF ground and signal paths. Additionally, one end of the RF coupler is connected to the wireless radio modem located inside the utility meter dielectric housing, while the other end of the RF coupler is routed via a suitable length coaxial RF cable and connected to a remote external antenna located outside the meter housing. The standalone RF coupler apparatus is located inside the meter housing and is connected such that it is providing a continuous RF signal path while simultaneously providing an electrical isolation in the RF signal and RF ground paths to the remote external antenna. The latter arrangement therefore has the effect of electrically isolating any exposed metallic components of a remotely connected external antenna that are connected to the output end of RF coupler apparatus, and are located outside of the dielectric meter housing, from the RF input connection of the RF coupler apparatus located inside the dielectric housing of the meter. The purpose of the electrical isolation provided by the RF coupler apparatus is to provide added electrical safety in the event of a high voltage fault condition appearing on the wireless modem side of the RF input of the RF coupler.

In yet another embodiment, one side of the conductive ground ring and center signal patch can be printed on the conductive surface of a dielectric printed circuit board (PCB) that hosts the radio modem with a transmission line between the modem and the printed ground ring and center signal patch. Dielectric spacing can be formed with a dielectric puck soldered directly over the printed image of the ground ring and signal patch. The RF connection to the dielectric ceramic puck is the essentially same way, but the same results are achieved in smaller dimensions while providing means for mounting the RF capacitive coupler to the host modem board.

Any of the aforementioned embodiments can be modified to have multiple input and multiple output connections strategically located on the top side or bottom sides of the coupling device to provide a multiplexing capability for multiple RF inputs and RF outputs.

The specific embodiments mentioned in this summary are included by example only and shall not limit the scope of this invention.

From the foregoing, it will be appreciated that it is a principal object of this invention to improve on prior art RF coupler designs by teaching a novel and economical mass production method of locating tethered or un-tethered integral RF coupler elements both within and external to the dielectric cover of a utility meter. Included in the description, as well as in some of the prior art, are commercially available manufacturing processes, formerly used in non-utility meter applications. The present invention teaches a new use for those existing processes and techniques. Other manufacturing techniques or processes not specifically referenced herein may later become directly or indirectly applicable to this invention, and all such additional processes are intended to be included within the spirit and scope of this invention.

Insofar as the applicant is aware, there are no former prior art designs that teach or recognize the improved performances specified in the present invention as it relates to the aforementioned shortcomings of the individual prior art in their respective field of inventions.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
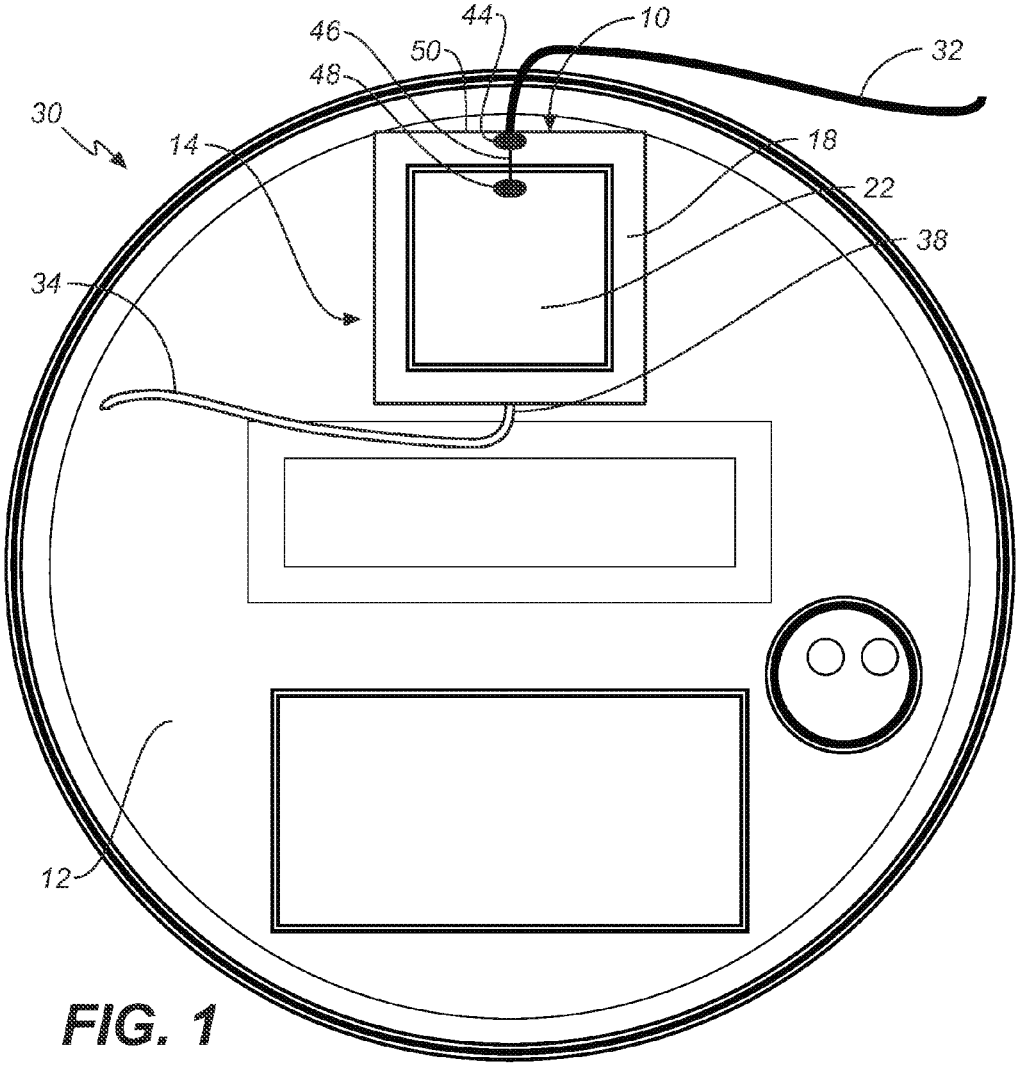
FIG. 1 is a schematic front view in elevation of a utility meter dielectric cover incorporating the inventive apparatus.

Referring to FIGS. 1 through 9, wherein like reference numerals refer to like components in the various views, there is illustrated therein a new and improved capacitive RF coupler for utility Smart meter radio frequency communications, generally denominated 10 herein.

Figure 2:
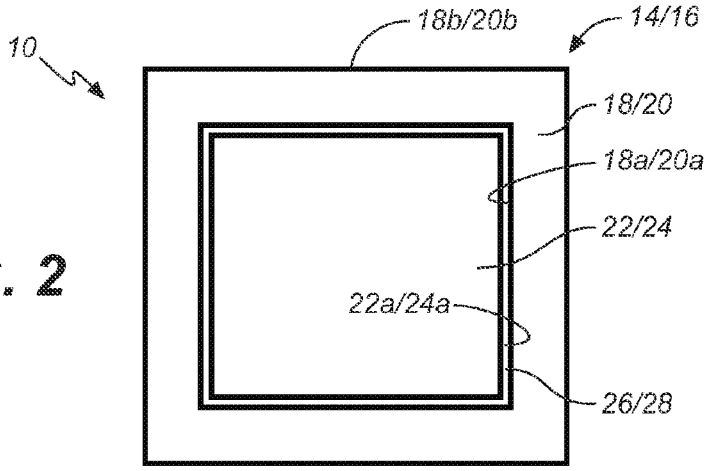
FIG. 2 is a schematic view in elevation of either (therefore both) the conductive elements only of the inner and outer conductive capacitive coupler signal patch and ground ring designed for dual band operation, not showing connections to RF input or output cables.

Referring first to FIG. 1, there is shown a utility meter dielectric cover incorporating the inventive apparatus, showing the RF coupler and a tethered coaxial connection to both sides of the RF coupler, with a 180 degree phase difference in the input versus output patch feeding points. FIG. 2 shows the inventive capacitive coupler signal patches, which, for clarity, shows the apparatus without the RF input and RF output cables attached, designed for dual band operation, which, in this view, are at the 900 MHz ISM band and 2.45 GHz ISM band.

Figure 6:
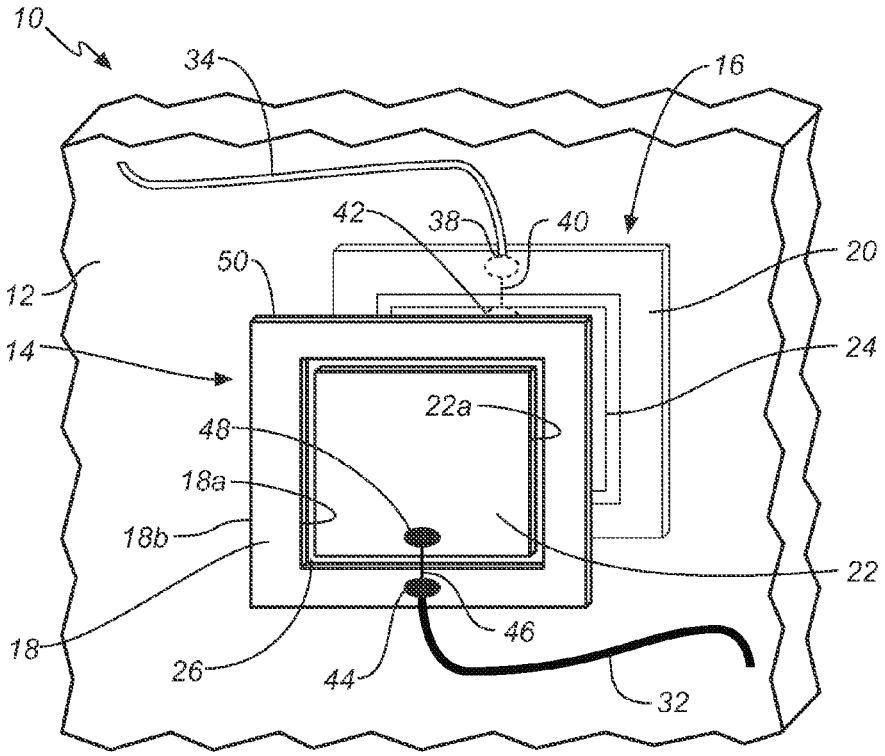
FIG. 6 is an upper front perspective view of the internal and external ground ring and signal patch, showing an RF coupler arranged on opposing sides of the meter dielectric front cover with an equivalent parallel-plate capacitive circuit schematic shown at right.

It will be seen, referring now to FIGS. 1, 2 and 6, that in a first preferred embodiment of the inventive capacitive RF coupler 10 of the present invention exploits the dielectric thickness and relative permittivity (Er) of the dielectric meter cover 12 to form an insulating dielectric between matching and paired outer and inner capacitive RF coupler members 14 and 16, respectively, each of the outer and inner coupler members including a conductive ground ring 18, 20, respectively, a conductive signal patch 22, 24 (outer and inner, respectively), and an insulating air gap 26, 28, respectively, separating the signal patches from the ground rings. The signal patches couple the RF signal path while the ground rings surrounding the signal patches couple the ground plane. In a preferred embodiment, the signal patches and ground rings are co-planar elements and can each be fabricated from conductive copper tape. Each ground ring has an inner edge 18*a*, 20*a* and an outer edge 18*b*, 20*b*, and is configured as a frame with its inner edge equidistantly spaced apart from the perimeter edge 22*a*, 24*a* of the centrally disposed signal patch. The insulating air gaps 26, 28 thereby formed in the space between the signal patch perimeter edge and ground ring inner edge provide electrical isolation between the centrally disposed signal patches 22, 24 and their respective outer ground rings 18, 20. The signal patches and ground rings constitute a "thin coaxial cable slice," wherein the centrally disposed signal patches represent the center conductor of a coaxial cable, and the surrounding outer ground rings represent the shielding in the sheath of a conventional coaxial cable. The design of this capacitive RF coupler 10 using paired and matching elements separated by a dielectric was approached to achieve a controlled impedance that matches that of the wireless modem within the utility meter 30 as well as the matching the characteristic impedance of the coaxial cable 32 exterior to the utility meter 30 and the transmission line 34 internal to the meter and connected to the modem itself.

Figure 6A:
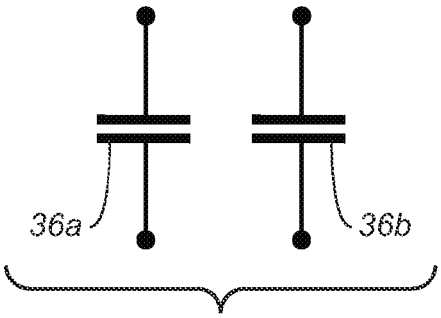
FIG. 6A is a schematic diagram showing the dual capacitors formed by the signal patches, and the corresponding ground rings, employed in the present invention, configured as plates separated by a dielectric.

In an exemplary and tested model of the preferred embodiment of this invention, as shown in FIG. 1 and FIG. 2, the characteristic impedance of the radio modem (not shown) and all transmission lines 32, 34 is 50-ohms. Therefore, the signal patches 22, 24 and ground rings 18, 20 were designed to be a 50-ohm impedance at the desired operating frequency of 900 MHz. Since the two signal patches 22, 24 shown in FIGS. 1 and 2 form a capacitor, from microwave transmission line theory, it can be appreciated that these two conductive signal patches 22, 24 are a parallel plate capacitor 36*a*, shown schematically in FIG. 6A. A second parallel plate capacitor 36*b*, shown schematically in FIG. 6A, is formed by the two conductive ground rings 18, 20.

At the desired operating frequency a good 50-ohm impedance can be calculated, using Equation 1 below, to have a series capacitive value of approximately 3.5 pF, where the capacitive reactance (Xc) of the parallel plate capacitance (formed by the two signal patches 22, 24, on either side of the dielectric meter cover 12) forms a capacitor.

Capacitive Reactance: $Xc=1/(2\cdot PI\cdot F(\text{GHz})\cdot C)$ Equation 1

It can be understood, from well-known parallel plate capacitance theory, that at a desired operation frequency of 900 MHz, for a meter cover 12 having a dielectric thickness of 2 mm, a relative dielectric permittivity of 2.0 and a desired capacitance of approximately 3.5 pF, the square area of the parallel signal patches, 22, 24 of the dimensioned FIG. 2 can be calculated to be 400 mm2 or 20 mm×20 mm.

Referring again to FIGS. 1, 2 and 6, the width of the outer ground ring 18, 20 in the illustrated example of the invention was chosen to be 6 mm for ease of prototyping the design. Other ground ring width dimensions are possible which modification can be reasonably expected to increase or reduce the effective capacitance as the effective plate capacitance is altered.

Referring still to FIGS. 1, 2 and 6, each ground ring 18/20 and signal patch 22/24 combination form one two-dimensional side of the RF coupler 10. The inner ground ring 20 and signal patch 24 assembly 16, is placed on the inside of the dielectric meter cover 12. An identical (matching) version 14 of this ground ring 20, and signal patch 24 device is placed on top of the outer surface of the dielectric meter cover 12 directly over the internally placed version 16 so as to directly and perfectly overlap it to form a complete parallel plate signal patch and overlapping ground ring.

This parallel (outer and inner) pair of signal patches and outer ground rings form the entire RF coupler 10. The inner assembly is fed with either two pogo pins (not shown) on the inside of the meter cover 12 (in the same fashion as the inventor's prior art Smart meter cover with integral un-tethered antenna elements for AMI communications as described in the present inventor's U.S. Pat. No. 8,228,209, incorporated in its entirety by reference herein) or, alternatively, a discrete coaxial cable 34, the latter which is permanently tethered to the inner signal patch 24 and ground ring 20 by soldering a connection of the coaxial cable shield to the ground ring 20 at a soldering point 38 and then using a center conductor wire 40 to connect the signal patch soldering point 42 on the inner signal patch 24, as shown by way of example in FIGS. 6 and 9. This coaxial cable 34, is then connected to the internal wireless radio modem (not shown but structurally well known) within the meter itself.

Referring now to FIG. 1, the outer signal patch 22 and ground ring 20 placed on the outside of the dielectric meter cover 12 also has a discrete coaxial cable 32 permanently soldered to it at a solder point 44 on ground ring 18, and connected by center conductor wire 46 at a signal feed 48 to signal patch 22, so as to provide the RF output from the outer RF coupler assembly 16 to the next item in the transmission system via an RF connector (not shown) at the end of the coaxial cable 32.

The entire coupler system therefore contains both an input coaxial cable feed 34 from the modem (or alternately two pogo pins [not shown] to make ground and signal connections) to the inner signal patch 24 and ground ring 20 as well as an outer patch 22 and ground ring 18 with a tethered external length of coaxial cable 32 that provides an RF output to the rest of the RF transmission system located external to the utility meter dielectric cover 12.

Figure 9:
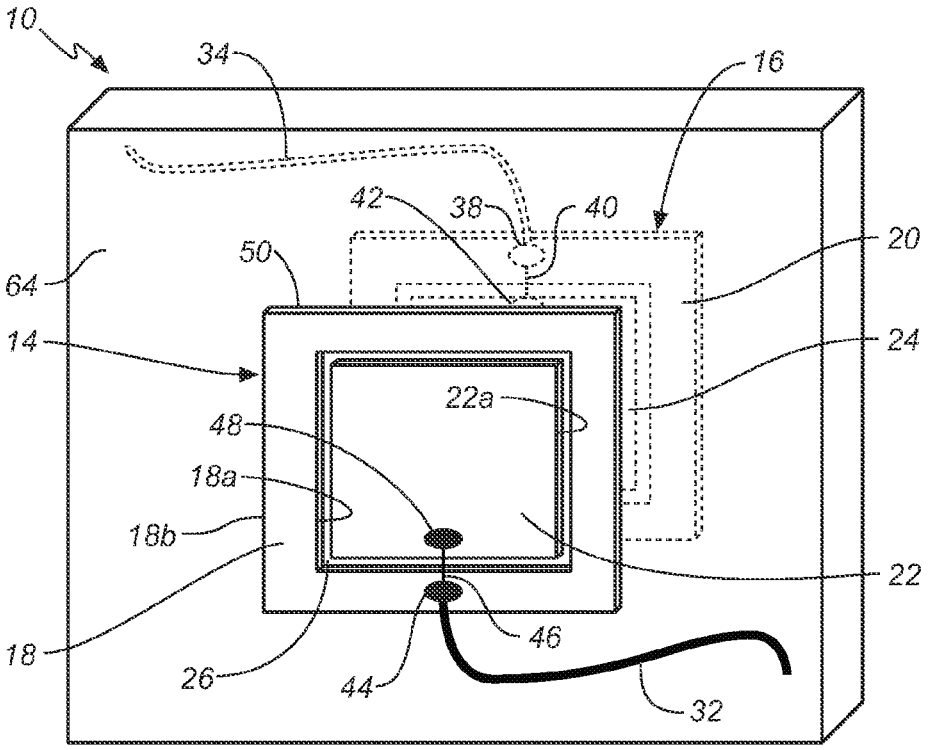
FIG. 9 is an exploded upper front perspective view of the internal and external ground ring and signal patch, with the RF coupler shown as a standalone apparatus fabricated on a thin dielectric substrate; with the equivalent parallel-plate capacitive schematic circuit shown in FIG. 6A.

Referring again to FIG. 1, the physical attachment points, to the coupler ground ring 18, 20 and the signal patches 22, 24, of the coaxial cables 32, 34 illustrated in FIGS. 1, 6 and 9 are critical for proper RF coupling and operation of the coupler ground rings 18, 20 and signal patches 22, 24. The coupler signal feed 48 is made by connecting the center conductor 46 of the signal wire from the coaxial cable 32 to the edge of the central signal patch 22 in the outer coupler assembly. Such a connection to the outer (output) coupler assembly 14, by way of example, is shown in FIGS. 1, 6 and 9. The coaxial cable shield provides an RF ground connection 44 which is made to the ground ring 18 in the outer coupler assembly 14. The position of both the RF ground connection 44 and signal feed connection 48 is at the edge of the outer coupler ground ring 18 and signal patch 22, respectively, but also substantially centered (or at the mid-point) along an edge 50 of the device. (This configuration may best be appreciated by reference to FIG. 6 and FIG. 9, the latter which shows an alternative embodiment of the inventive apparatus, using a standalone dielectric material, but in every other respect is structurally and operatively identical to this first preferred embodiment.)

For minimal insertion loss the arrangement of the inner signal patch 24 and ground ring 20 on the input, or opposing coupler assembly 16 on the inside of the meter dielectric 12, is connected via a coaxial cable 34 with a 180-degree geometrical or angular difference (along the opposite edge of the corresponding outer ground ring 18 and signal patch 22). Again, the signal wire from the coaxial cable 34 is soldered to the center signal patch 24 while the ground shield from the coaxial cable is soldered to the outer ground ring 20, with the connection made at the mid-point along the edge of the signal patch and ground ring on the side opposite the input patch 22 and ring 18 so as to provide a 180-degree geometrical or angular difference from input to output feed points of the corresponding ring and patch arrangements.

Figure 5:
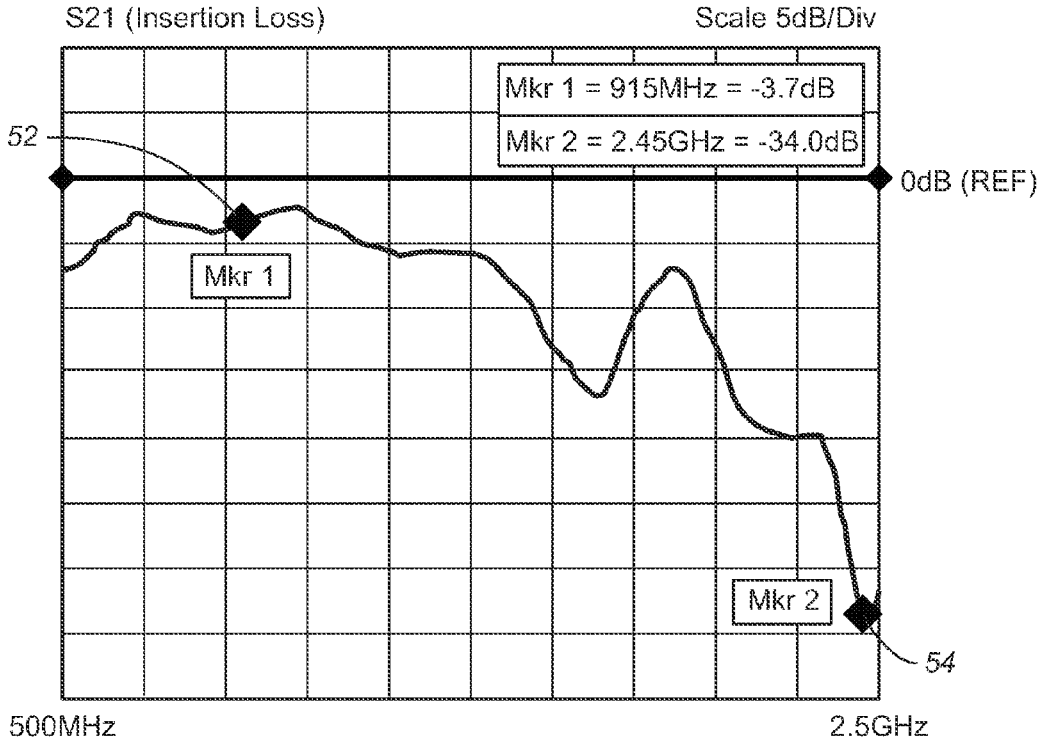
FIG. 5 a graph line showing an insertion loss (S21) measurement of a −34 dB isolation achieved at 2.45 GHz using a 270 degree output coupler feeding point.

Referring now to line drawing in FIG. 5, the RF insertion loss (or RF isolation) is shown for Marker 1, 52, which shows a loss of −3.7 dB at 915 MHz, and Marker 2, 54 which shows a loss of −34 dB at 2.45 GHz. These values were measured using a vector network analyzer and were achieved by modifying the geometrical or angular difference between the RF input and the RF output coupler feed points to 270 degrees. It can be seen and understood therefore, that a difference in the feeding input to the feeding output connection points along the edge of this parallel plate RF coupler system configuration 14, 16 (signal patches 22/24 and ground rings 18/20), has the ability to change the amount of RF energy that is coupled between the parallel signal patches 22/24 and ground rings 18/20 of the RF coupler internal and external assemblies 16/14 respectively, due to the phase relationship effect on the electromagnetic energy and resulting surface currents generated and that are flowing in the conductive surfaces of the RF coupler. It is clear then by referring to FIGS. 3 and 5 that the geometrical angle of connection of the relationship between the input to output feeding points of the RF coupler 10, modifies the RF insertion loss or RF isolation that the RF coupler assembly 10 presents to the RF signal passing through the device at different frequencies.

Figure 3:
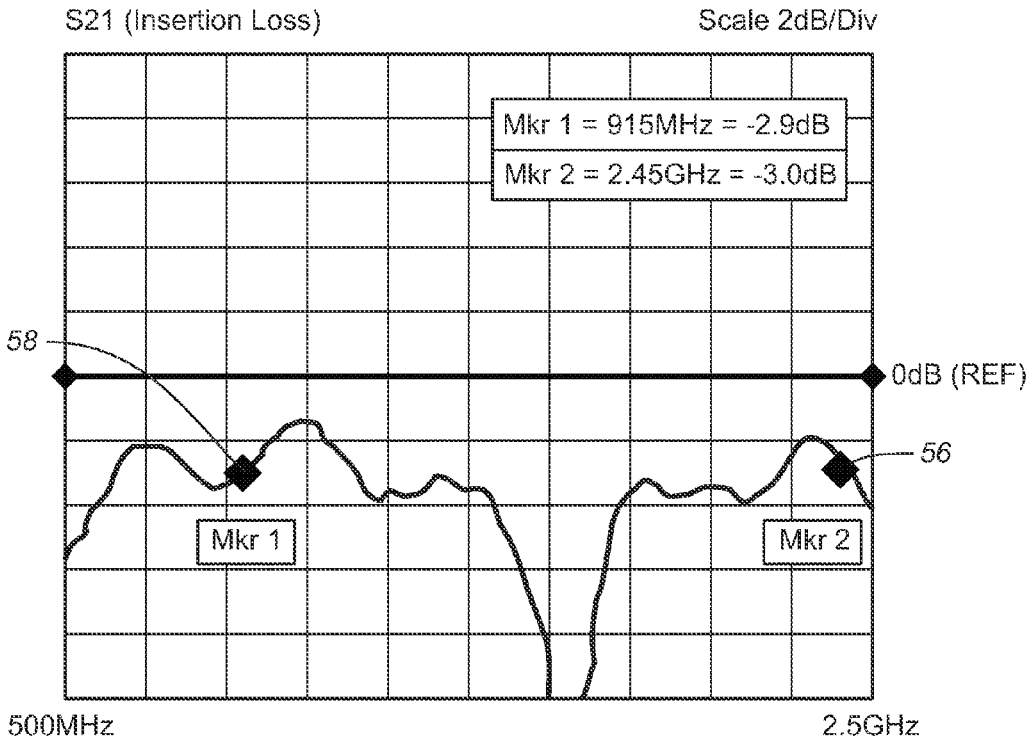
FIG. 3 is a graph showing an insertion loss (S21) measurement for the capacitive RF coupler of the present invention, as measured using an output coupler having an RF feed point oriented 180 degree relative to the input RF feed point of the coupler.

Referring now to FIG. 3, a 900 MHz/2.45 GHz capacitive RF coupler at 2.45 GHz had a measured RF insertion loss at Marker 2, 56 coupling tightly (−3.0 dB) and an RF insertion loss at Marker 1, 58 coupling tightly (−2.9 dB) when a 180 degree feed relationship between coupler assemblies 14, 16 is used, whereas in FIG. 5 a 270-degree feed relationship creates a significant −34 dB RF isolation at 2.45 GHz indicated by Marker 2, 54, while the 915 MHz signal is still tightly coupled as indicated by marker 1, 52 (−3.7 dB) in the same FIG. 5.

Figure 4:
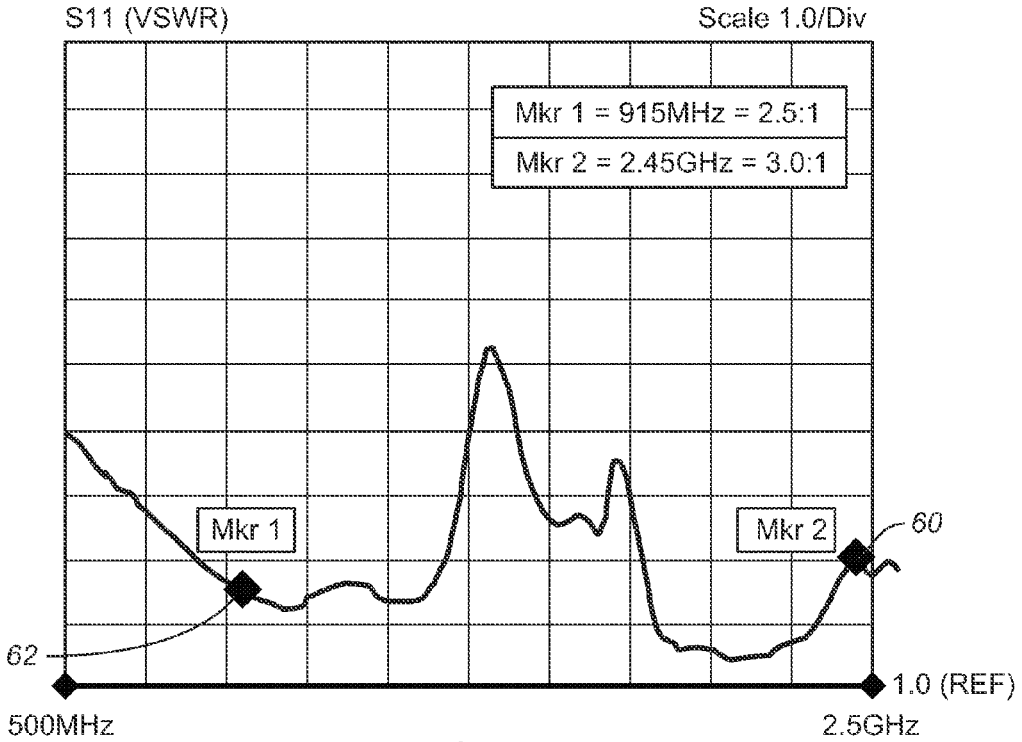
FIG. 4 is a graphs showing an input voltage standing wave ratio (S11 VSWR) measurement for the capacitive RF coupler.

FIG. 4 shows an input voltage standing wave ratio (VSWR) for the capacitive RF coupler, indicating that at 915 MHz, Marker 1, 62, the VSWR is 2.5:1 and that at 2.45 GHz, Marker 2, 60 it is 3.0:1. In the latest production version of the inventive apparatus VSWR values of under 1.5:1 have consistently been achieved over a large bandwidth, and by reduction of the dielectric thickness RF insertion loss values of under −0.5 dB at much of the operational bandwidth have been achieved using some optimization of the dimensions shown in the prototype model illustrated in FIG. 2.

Similarly it will be understood that this RF coupler arrangement may be scaled to operate at other impedances, for example 75-ohms, or at other higher or lower operating frequencies by using the methods taught in the illustrated figures by modifying the dimensions of the signal patches and ground rings to suit other desired operating frequencies or rejection frequencies that the designer may choose for the RF transmission system.

Referring now FIG. 9 it will be readily appreciated that by substituting the dielectric meter cover 12 of FIGS. 1 and 6, with a thin and standalone dielectric substrate 64, shown in FIG. 9, that the apparatus created is a discrete two port capacitive RF coupler component that stands separate from the utility meter dielectric cover 12. This two port capacitive RF coupler component 10 may be created with substantially the same mechanical dimensions, electrical and RF properties as described in the above preferred and alternate embodiments of this invention and having the same operation as described in the operation of the preferred and alternate embodiments below. Preferably, the ground rings 18/20 and signal patches 22/24 are etched from a double-sided copper clad, 45 mm×45 mm×1 mm printed circuit board (PCB) 64 dielectric (epoxy with preimpregnated [prepreg] composite fibers), such as FR4 with surface mount or through hole mount RF coaxial connectors each side. In this standalone embodiment, as with the embodiments incorporated into a utility meter dielectric cover, the RF input (source) connection is preferably made at the midpoint, along one side of the ground ring and signal patch. The RF input coaxial connector has its ground shield attached to the ground ring 18 and the cable center signal feed 22 is attached the same distance in from the edge of the ground ring to the edge of the signal patch. The corresponding RF output (load) connection is made on the opposite face of the PCB 64 (with a 180-degree angular difference) (or meter cover for the meter cover mounted embodiments) at the midpoint along one of side of the ground ring and signal patch, with the RF output connector ground shield attached to the ground ring 20, and the connector center signal feed attached the same distance in from the edge to the edge of the signal patch 24. In the standalone version of the inventive coupler 10, the apparatus is placed within the confines of at least the outer dielectric cover 12 of the utility meter 30 to enable it to be routed in series between the coaxial cable extending outside the meter and the RF modem contained within the confines of the meter dielectric cover, thereby providing electrical safety isolation for any conductive components located on the outside of the utility meter dielectric cover.

Operation.

Referring again to FIG. 1, the RF energy is applied at a frequency of 900 MHz and 2.45 GHz, from the internal wireless modem (not shown), within the dielectric housing of the utility meter 12, to the input feed coaxial cable 34 that feeds the inner patch 24 and ring 20 coupler assembly described above.

Referring now to FIGS. 2 and 6, the RF energy is coupled across the dielectric meter cover 12 since it is designed, with the physical dimensions shown (by way of example only), for a matching 50-ohm impedance to have a parallel plate capacitance value of about 3.5 pF by means of the parallel plate capacitance formed between the pair of 20 mm×20 mm signal patches 22, 24, each signal patch framed by a ground ring measuring 35 mm×35 mm and each signal patch spaced from its corresponding ground ring by an air space measuring 1.0 mm across.

The ground currents flowing in the coaxial shielding of the RF coaxial cables 34, 32 are similarly coupled across the dielectric meter covers, 2 mm dielectric thickness, by the ground ring 18, 20 parallel pair either side of the meter cover 12.

Referring again to FIG. 1, the outer (output) coupler assembly 14, connected to the external coaxial cable 32, maintains a continuous 50-ohm characteristic impedance match to the output coaxial cable 32 due to the matching dimensions.

Figure 7:
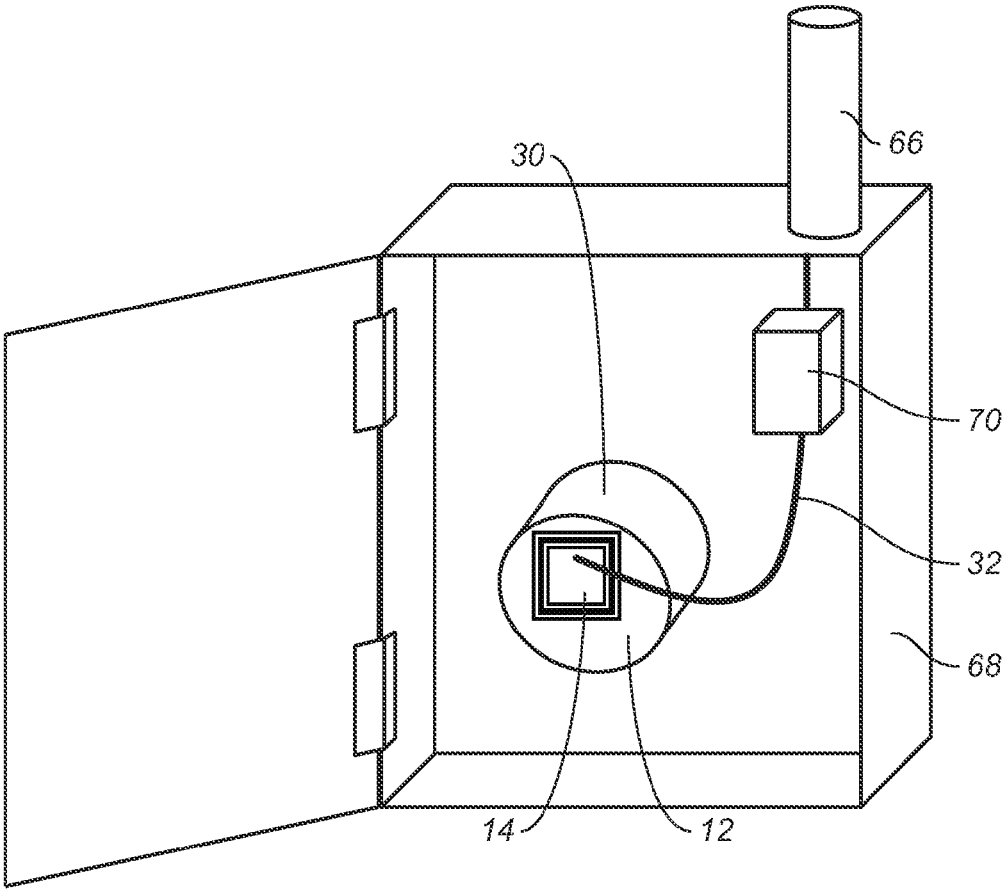
FIG. 7 is a highly schematic upper front perspective view of a vandal proof enclosure housing a wireless-enabled utility meter, shown here with an external bulk-head mounted external antenna located on top of the enclosure along with an optional in-line power amplifier.

Referring now to FIG. 6, RF energy flows between the inner RF coupler assembly 16 and outer RF coupler assembly 14 into the external coaxial cable 32. Referring now to FIG. 7, this RF energy flows from the outer RF coupler assembly 14 into its tethered coaxial cable 32 which is connected to the next component in the transmission system, which may be an external remote antenna 66, mounted on the outside of the vandal proof metal meter enclosure 68 or optionally an in-line power amplifier 70 to boost the RF signal further.

Again, it will be understood that this RF coupler 10 arrangement with parallel and matching outer and inner RF coupler assemblies 14, 16, may be scaled to operate at other impedances, for example 75 Ohms, or at other higher or lower operating frequencies by using the methods taught in the illustrated figures by modifying the dimensions of the patch 22, 24 and ring 18, 20 to suit other desired operating frequencies or rejection frequencies that the designer may choose for the RF transmission system.

Further, referring now to the alternate embodiment of FIG. 9 and the above operation of the preferred embodiment shown in FIGS. 1, 2 and 6, it will be appreciated that the same operation will similarly apply to the stand alone alternate embodiment of the apparatus shown in FIG. 9. In addition to the above described operation, by locating the stand alone RF coupler illustrated in FIG. 9 within the utility meter dielectric housing and by connecting the input RF coaxial cable 34, to the RF input connector of the wireless radio modem (not shown) that is also located within the confines of the utility meter dielectric housing, and then connecting the output RF coaxial cable 32 of the apparatus to a remote external antenna (not shown) located outside of the utility meter housing, any high voltage current induced due to a fault condition on the wireless modem side of the apparatus or by a lightning strike on a power line cable upstream from the utility meter installation, will now be electrical isolated in both the RF ground 18/20 and RF signal paths 22/24 of the RF coupler component 10 thereby insuring a good measure of electrical isolation and shock hazard safety for any exposed conductive surfaces of the remote external antenna or exposed external conductive hardware to which it may be connected.

Conclusion, Ramifications, and Scope.

Referring now to FIGS. 1, 2, 6 and 7, and the above described embodiment of this invention and the corresponding measurement results shown in FIGS. 3, 4 and 5 demonstrate that a low insertion loss RF coupling is possible, through the dielectric meter cover housing without need for drilling a hole in the meter cover. The latter means of drilling a hole in the meter cover, or alternately in the utility meter bulk head wall, to directly route the RF cable and signal would otherwise negatively impact the integrity of the seal of the utility meter housing and expose the sensitive meter electronics to undesirable and possibly corrosive effects of the external weather and moisture in the atmosphere, but more importantly a direct RF connection from the internal wireless modem to the external antenna would render the utility meter installation unsafe by posing an electrical shock hazard to personnel.

Referring now to FIGS. 5 and 6, it has been shown that this RF coupler invention also further improves on prior art examples of capacitive couplers, used in the automotive external glass mount antenna systems, by deploying an innovative and novel phase-sensitive coupler feeding system to the center signal patch and ground ring parallel plate configuration that allows for a unique frequency selective pass-band coupling as well as good amount of RF rejection while maintaining a good matching impedance to input and output components in the RF transmission system to insure a low loss RF coupling at the desired operating frequency. These frequency selective properties can be very useful for Automated Metering Infrastructure (AMI) and Home Area Network (HAN) applications or telecommunications and GPS satellite communications where specific frequencies may need to be rejected by the RF coupler to prevent RF or Electro Magnetic Interference (EMI) with the utility meter's radio from neighboring or adjacent wireless networks such as 802.11b/g wireless in-home networks, Bluetooth or Zigbee 2.4 GHz ISM band devices or 2.4 GHz ISM band residential cordless phones.

The method and description, for the apparatus above, of this innovative and integrated meter cover mounted RF coupler allows utility companies and automated meter infrastructure (AMI) vendors to choose to install utility meters inside vandal proof cabinets by swapping existing meter covers with a replacement cover containing the RF coupler described in this disclosure, thereby allowing an easy but efficient means of connecting the wireless-enabled Smart meter to a remote external antenna mounted on the outside of the metal vandal proof enclosure without affecting the serviceability or integrity of the seal of the utility meter or the electrical safety of the installation.

Figure 8:
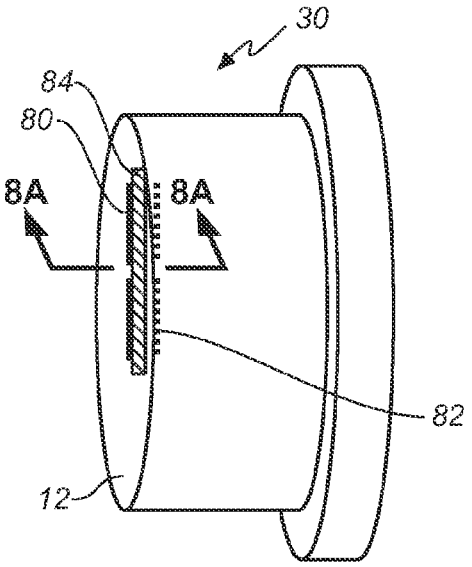
FIG. 8 is a perspective side view showing a utility meter with the an alternative embodiment of the inventive apparatus, using a pair of antennas for the coupling elements, instead of the preferred embodiment installed on the meter housing.
Figure 8A:
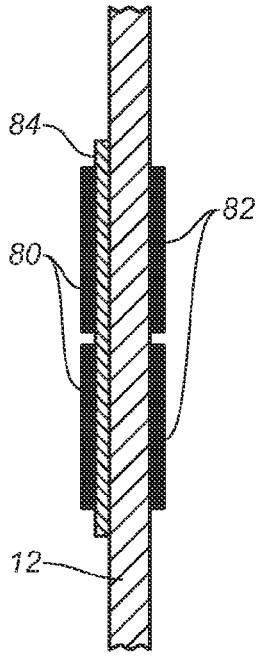
FIG. 8A is a detailed side view in elevation showing the matching antennas defined by section lines A-A through the front dielectric cover of a utility meter of FIG. 8.

Referring now to FIGS. 8 and 8A, in yet another embodiment of the apparatus in the above described invention, the pair of RF coupler signal patches and ground rings shown in the other embodiments of this disclosure may be replaced with a pair of matching antennas elements 80, 82. FIG. 8 shows matching antennas, including an un-tethered internal antenna element 82 forming a part of the meter cover and an external antenna 80 fabricated on flexible printed circuit substrate 84 and held in place with adhesive (tethered to a coaxial cable, which is not shown). The pair of matching antenna elements illustrated is substituted in place of the preferred RF coupler embodiment of the invention to form an alternate RF close-coupling method. In this alternate embodiment of the invention, the internal antenna 82 is an un-tethered antenna with its conductive elements incorporated substantially into the material comprising the dielectric cover 12 of the meter housing and with its connection to the meters wireless modem (not shown) made via a spring or pogo pin connection (not shown) as referenced in the inventor's U.S. Pat. No. 8,228,209.

Still referring to FIGS. 8 and 8A, the external antenna 80 is a flexible PCB antenna structure disposed in close proximity and directly over the top of the integral un-tethered meter cover mounted antenna 82. The two antennas are designed to be matching in impedance, frequency of operation and physical apertures so that they directly overlap each other on the inside and outside of the meter dielectric cover 12. It can be understood and appreciated from the methods described above for the preferred embodiment that these two antennas 80, 82 will similarly closely couple in order to provide a tight RF coupling across the meter dielectric cover 12 affording the same benefits and advantages previously mentioned in the preferred embodiment of this invention above.

The two-dimensional structure and integral-to-dielectric-cover nature of the present invention, eliminates the need for more expensive three dimensional structures for the coupler. This structural simplicity and use of the dielectric meter cover for mounting on, as well the use of pogo-pins, from the inventors prior art, for the un-tethered internal coupler, is thus a lower cost alternative to the cited prior art examples while performance is enhanced.

Referring again to the alternative "standalone" embodiment of the present invention, illustrated in FIG. 9, the RF coupler of the present invention may be located within the confines of the utility meter dielectric cover and used by utilities and meter manufacturers to provide a means of enabling a remotely mounted external antenna to be connected to a wireless radio modem located within the confines of utility meter cover, via this standalone RF coupler apparatus, without compromising the electrical safety of the utility meter installation.

In yet another embodiment of this invention (not illustrated), one side of the conductive ground ring and center signal patch can be printed on the conductive surface of a dielectric printed circuit board (PCB) that hosts the radio modem with a 50-ohm transmission line between the radio modem and the printed ground ring and center signal patch. In this embodiment the dielectric spacing can be formed with a dielectric puck, (for example ceramic), soldered down directly over the printed image of the ground ring and signal patch. The dimensions of the ground ring and signal patch on the PCB will be smaller in size, than the meter-incorporated preferred embodiments described above, due to the higher dielectric constant effect of the ceramic dielectric loading compared to the meter cover lower dielectric constant value or a PCB dielectric constant value (for example the FR4) discussed in the stand alone embodiment. Using a thick film conductor or other similar manufacturing process, the top side of the dielectric ceramic puck will have printed on it a conductive ground ring and signal patch that is a mirror image of the printed ground ring and signal patch on the printed circuit board. The RF connection to the dielectric ceramic puck is made in the same way as the preferred embodiments of this invention to achieve the same results but with a smaller dimension, at the same time providing means for mounting the RF capacitive coupler to the host modem board.

In yet another embodiment of this invention, any of the aforementioned embodiments can be modified to have multiple input and multiple output connections strategically located on the top side or bottom sides of the coupling device to provide a multiplexing capability for multiple RF inputs and RF outputs. These would be useful for connecting multiple RF modems to a single antenna or multiple antennas to a single RF modem. The principles and methods of construction would be similar to the aforementioned embodiments with the exception of the location and number of connections on the input and output.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. For instance, the centrally disposed signal patch in each RF coupling assembly could be circular or configured in any of a number of substantially uniform polygonal shapes. Correspondingly, the ground ring framing the signal patch (in non-rounded configurations) would be shaped with an inner edge parallel to the immediately adjacent perimeter edge of the signal patch and outer edges parallel to the inner edge. In a round configuration, the ground ring would be equidistantly spaced apart and concentric with the signal patch.

Likewise, it will be appreciated that input and output signal patch feeding points can be varied considerably, though 180, 90, and 270 phase differences appear to be most practicable. Such variations in input and output signal feed configurations are contemplated in the present invention, though not all variations could possibly be shown. Additionally, the particular kind of conductors or cables providing the RF input and RF output can be varied and each of the signal patches and ground rings can be terminated with connectors of different kinds, including, for instance, coaxial or dual conductor connectors.

It will be seen, therefore, that in its most essential aspect, the present invention is a capacitive RF coupler arranged in a parallel plate configuration for use in utility Smart meter radio frequency communications. The inventive device includes first and second RF coupling assemblies, each having a substantially planar conductive signal patch with an outer edge, a substantially planar conductive ground ring having an inner edge equidistantly spaced apart from the outer edge of the signal patch so as to create an insulating air gap between the signal patch and the ground rings, wherein the ground ring has both inner and outer edges that correspond to the geometrical shape of the outer edge of the signal patch (parallel in the case of geometrically shaped signal patches, concentric in the case of circular signal patches); a dielectric material disposed between the first and second RF coupling assemblies such that the signal patches and ground rings of the respective RF coupling assemblies are in a conformational parallel relationship to one another (one is placed immediately over the other). The device next includes a grounded RF input signal conductor having a ground portion connected to the ground ring of the first RF coupling assembly at a point a distance from the outer edge of the ground ring and a signal conductor portion connecting the ground ring of the first RF coupling assembling to the signal patch of the first RF coupling assembly at a distance from the perimeter edge of the signal patch of the first RF coupling assembly generally equal to the distance of the point from the ground ring outer edge at which the ground portion of the RF input signal cable is connected to the ground ring; and a grounded RF output signal conductor having a ground portion connected to the ground ring of the second RF coupling assembly at a point a distance from the outer edge of the ground ring and a signal conductor portion connecting the ground ring of the second RF coupling assembling to the signal patch of the second RF coupling assembly at a distance from a perimeter edge of the signal patch of the second RF coupling assembly generally equal to the distance of the point from the ground ring outer edge at which the ground portion of said RF output signal conductor is connected to said ground ring. The RF coupler provides electrical isolation in both the RF signal and RF ground paths.

Therefore, the above description and illustrations should not be construed as limiting the scope of the invention, which is defined by the appended claims.

What is claimed as invention is:

1. A capacitive RF coupler arranged in a parallel plate configuration for use in utility Smart meter radio frequency communications, comprising:

a first RF coupling assembly including a substantially planar conductive first signal patch having an outer edge, a substantially planar conductive first ground ring co-planar with said first signal patch and having an inner edge equidistantly spaced apart from said outer edge of said first signal patch so as to create an insulating air gap between said first signal patch and said first ground ring, said first ground ring having an outer edge that corresponds to the geometrical shape of said outer edge of said first signal patch;

a second RF coupling assembly including a substantially conductive planar second signal patch having an outer edge, a substantially planar conductive second ground ring co-planar with said second signal patch and having an inner edge equidistantly spaced apart from said outer edge of said second signal patch so as to create an insulating air gap between said second signal patch and said second ground ring, said second ground ring having an outer edge that corresponds to the geometrical shape of said outer edge of said second signal patch;

a dielectric layer disposed between said first and second RF coupling assemblies such that said first signal patch and said first ground ring of said first RF coupling assembly and said second signal patch and said second ground ring of said second RF coupling assembly are in a conformational parallel relationship to one another;

a grounded RF input cable having a ground portion connected to said first ground ring and a signal conductor portion connected said first signal patch; and a grounded RF output cable having a ground portion connected to said second ground ring and a signal conductor portion connected to said second signal patch;

wherein said RF coupler provides electrical isolation in both the RF signal and RF ground paths.

2. The RF coupler of claim 1, wherein said first and second signal patches are shaped and sized substantially identically, and wherein said first and second ground rings are shaped and sized substantially identically.

3. The RF coupler of claim 1, wherein said ground portion of said RF input cable is connected to said first ground ring at a point a distance from said outer edge of said first ground ring and said signal conductor portion is connected to said first signal patch at a distance from said outer edge of said first signal patch generally equal to the distance of said point at which said ground portion of said RF input cable is connected to said first ground ring; and wherein said ground portion of said RF output cable is connected to said second ground ring at a point a distance from said outer edge of said second ground ring and said signal conductor portion is connected to said second signal patch at a distance from said outer edge of said second signal patch generally equal to the distance of said point at which said ground portion of said RF output cable portion is connected to said second ground ring.

4. The RF coupler of claim 1, wherein said RF input cable is connected to said first ground ring and said first signal patch in an orientation 180 degrees apart from the point at which said RF output cable is connected to said second ground ring and said second signal patch.

5. The RF coupler of claim 1, wherein said RF input cable is connected to said first ground ring and said first signal patch in an orientation either 0 degrees, 90 degrees, 180 degrees, or 270 degrees apart from the point at which said RF output cable is connected to said second ground ring and said second signal patch.

6. The RF coupler of claim 1, wherein each of said RF input cable and said RF output cable is a tethered coaxial cable.

7. The RF coupler of claim 1, wherein said dielectric layer is a utility meter cover.

8. The RF coupler of claim 1, wherein said dielectric layer is a substantially planar layer of insulated dielectric circuit board.

9. The RF coupler of claim 1, wherein said dielectric layer is a substantially planar layer of ceramic dielectric.

10. The RF coupler of claim 1, wherein said first and second signal patches, said first and second ground rings, and said RF input and RF output signal connectors are dimensionally designed for proper operation at the desired radio frequencies.

11. An RF coupler and electrical safety isolator for providing electrical isolation in both RF signal and RF ground paths in utility Smart meters, comprising:

first and second RF coupling assemblies configured in a parallel plate arrangement, each of said RF coupling assemblies having a substantially planar conductive signal patch having a perimeter edge, a substantially planar conductive ground ring having an inner edge equidistantly spaced apart from said perimeter edge of said signal patch so as to create an insulating air gap between said signal patch and said ground ring, said ground ring having both inner and outer edges that correspond to the geometry of said outer edge of said signal patch;

a dielectric material disposed between said first and second RF coupling assemblies in such a manner that said planar conductive signal patch and said substantially planar conductive ground ring of said first RF coupling assembly and said planar conductive signal patch and said substantially planar conductive ground ring of said second RF coupling assembly are in a parallel plate relationship to one another;

an RF input cable having a ground portion connected to said ground ring of said first RF coupling assembly at a point a predetermined distance from an outer edge of said ground ring and a RF input cable signal conductor portion connected to said signal patch of said first RF coupling assembly at a distance from an edge of said signal patch of said first RF coupling assembly generally equal to the distance of said predetermined point at which said ground portion of said RF input cable is connected to said ground ring; and an RF output cable having a ground portion connected to said ground ring of said second RF coupling assembly at a point a predetermined distance from an outer edge of said ground ring and a RF output signal conductor portion connected to said signal patch of said second RF coupling assembly at a distance from an edge of said signal patch of said second RF coupling assembly generally equal to the distance of said predetermined point at which said ground portion of said RF output cable is connected to said ground ring;

wherein said RF coupler provides electrical isolation in both the RF signal and RF ground paths.

12. The RF coupler and electrical safety isolator of claim 11, wherein said first and second signal patches couple the RF signal path and said first and second ground rings surrounding said first and second signal patches, respectively, couple the ground plane.

13. The RF coupler and electrical safety isolator of claim 11, wherein said air gaps provide electrical isolation between said first and second signal patches and said first and second ground rings, respectively.

14. The RF coupler and electrical safety isolator of claim 11, wherein the impedance of said first and second signal patches and said first and second ground rings matches the impedance of a wireless modem within a utility meter, the characteristic impedance of the said RF output cable, and any transmission line internal to the utility meter and connected to the wireless modem.

15. The RF coupler and electrical safety isolator of claim 11, wherein said first RF coupler assembly is disposed on the inside of a dielectric utility meter cover and said second RF coupler assembly is placed on the outer surface of the dielectric utility meter cover, and wherein said first and second RF coupler assemblies have matching ground rings and signal patches, and said second RF coupler assembly is placed directly over the internally placed RF coupler assembly so as to directly and perfectly overlap it to form a complete parallel plate signal patch and overlapping ground ring.

16. The RF coupler and electrical safety isolator of claim 11, wherein said RF input signal cable is provided either by a pair of pogo pins located on the inside of the meter cover that are in turn connected to a discrete coaxial cable that is connected to the meter modem RF connector.

17. The RF coupler and electrical safety isolator of claim 11, wherein said RF output cable is connected to an RF output transmission and reception system having at least some operative elements located outside of the utility meter outer dielectric cover.

18. The RF coupler and electrical safety isolator of claim 11, wherein said dielectric layer is a substantially planar layer of printed circuit board, and wherein both of said first and second RF coupler assemblies are positioned entirely within a utility meter dielectric housing, and said RF input signal conductor is connected to an input connector of a wireless radio modem also located within the utility meter dielectric housing, and said RF output cable is connected to a remote external antenna located outside the utility meter dielectric housing, thereby providing electrical isolation in both the RF ground and RF signal paths of the RF coupler and shock hazard safety for any exposed conductive surfaces of the remote external antenna or the utility meter's installation conductive hardware such as the meter socket or vandal proof cabinet.

19. The RF coupler and electrical safety isolator of claim 11, wherein each of said first and second signal patches and said first and second ground rings have multiple input and multiple output RF connections to provide a multiplexing capability for multiple RF inputs and RF outputs.

20. The RF coupler of claim 1 and the RF coupler and electrical safety isolator of claim 11, wherein each of said first and second signal patches and said first and second ground rings are terminated with coaxial or dual conductor connectors.

* * * * *